US008911691B2

(12) United States Patent
Giraud et al.

(10) Patent No.: US 8,911,691 B2
(45) Date of Patent: Dec. 16, 2014

(54) RACK WITH VIAL

(75) Inventors: Jean-Pierre Giraud, Auburn, AL (US); David Chedotal, Greisheim Pres Molsheim (FR)

(73) Assignee: Capitol Plastic Products, LLC, Amsterdam, NY (US)

( * ) Notice: Subject to any disclaimer, the term of this patent is extended or adjusted under 35 U.S.C. 154(b) by 711 days.

(21) Appl. No.: 12/993,947

(22) PCT Filed: Jun. 5, 2009

(86) PCT No.: PCT/US2009/046366

§ 371 (c)(1), (2), (4) Date: Jan. 19, 2011

(87) PCT Pub. No.: WO2009/149324

PCT Pub. Date: Dec. 10, 2009

(65) Prior Publication Data

US 2011/0123416 A1 May 26, 2011

Related U.S. Application Data

(60) Provisional application No. 61/059,398, filed on Jun. 6, 2008.

(51) Int. Cl.

| | |
|---|---|
| ***B01L 3/00*** | (2006.01) |
| ***B01L 9/00*** | (2006.01) |
| ***B01L 9/06*** | (2006.01) |

(52) U.S. Cl.

CPC ..... *B01L 3/5082* (2013.01); *B01L 3/5453* (2013.01); *B01L 9/06* (2013.01); *B01L 2300/022* (2013.01); *B01L 2200/025* (2013.01); *B01L 2200/087* (2013.01)

USPC ..... 422/558; 422/561

(58) Field of Classification Search

CPC ..... B01L 9/00; B01L 9/06; B01L 2200/025

USPC ..... 422/558, 560–562

See application file for complete search history.

(56) References Cited

U.S. PATENT DOCUMENTS

| | | | |
|---|---|---|---|
| 3,081,029 | A | 3/1963 | Kjetil |
| 3,800,956 | A | 4/1974 | Nishizawa |

(Continued)

FOREIGN PATENT DOCUMENTS

| | | | |
|---|---|---|---|
| EP | 0109558 | A2 | 5/1984 |
| EP | 1898217 | A2 | 3/2008 |

(Continued)

OTHER PUBLICATIONS

European Patent Office, Supplementary European Search Report in Application No. 09759483.2-2113, dated May 18, 2011.

(Continued)

*Primary Examiner* — Paul Hyun

(74) *Attorney, Agent, or Firm* — David B. Gornish

(57) ABSTRACT

A sample vial [24] is disclosed, having a generally tubular body [32]. The vial [24] has a generally round lip [34] defining an opening [36] at the top of the body [32]. The vial [24] has a foot [38] at the base of the body [32], having asymmetric first and second sides [40, 42]. A rack [28] is disclosed for supporting such a sample vial [24]. The rack [28] supports the sample vial [24] in a generally upright position in a single orientation. The rack [28] has an asymmetric recess [50] adapted to receive the asymmetric foot [38] in a single orientation. The rack [28] also has an orientation abutment [82] adapted to interfere with a projecting abutment [46] of a vial [24] to prevent insertion of a vial [24] into the asymmetric recess [50] in an orientation other than the single orientation. The orientation abutment [82] also allows insertion of a vial [24] into the asymmetric recess [50] in the single orientation.

7 Claims, 7 Drawing Sheets

(56) References Cited

U.S. PATENT DOCUMENTS

| | | | | | |
|---|---|---|---|---|---|
| 4,124,122 | A | * | 11/1978 | Emmitt | 211/74 |
| 4,785,953 | A | * | 11/1988 | Buchholz et al. | 215/365 |
| 5,156,813 | A | * | 10/1992 | Calhoun | 422/557 |
| 5,409,667 | A | * | 4/1995 | Elson | 422/562 |
| 7,219,800 | B2 | | 5/2007 | Bulow | |
| 7,632,467 | B1 | * | 12/2009 | Mason | 422/569 |
| 2002/0129525 | A1 | | 9/2002 | Kissinger | |
| 2006/0000296 | A1 | | 1/2006 | Salter | |

FOREIGN PATENT DOCUMENTS

| | | | |
|---|---|---|---|
| FR | 1206356 | A | 2/1960 |
| FR | 2395780 | A1 | 1/1979 |
| FR | 2804510 | A1 | 8/2001 |
| JP | 11-221266 | A | 8/1999 |
| WO | WO01/60518 | | 8/2001 |

OTHER PUBLICATIONS

Patent Cooperation Treaty, Notification of Transmittal of the International Search Report and the Written Opinion of the International Searching Authority, or the Declaration, in Application No. PCT/US2009/046366, dated Jan. 7, 2010.

Patent Cooperation Treaty, Notification Concerning Transmittal of International Preliminary Report on Patentability, in Application No. PCT/US2009/046366, dated Dec. 16, 2010.

* cited by examiner

RACK WITH VIAL

RELATED APPLICATION

This application is a 371 National Phase filing of International Patent Application Ser. No. PCT/US2009/046366 filed Jun. 5, 2009, which claims priority to U.S. patent application Ser. No. 61/059,398 filed Jun. 6, 2008. The above applications are incorporated herein by reference in their entirety.

BACKGROUND

Sample vials are used for collecting multiple specimens of analytes for analysis. For example, on a dairy farm, the milk of each animal may be sampled frequently and the samples sent to a laboratory to analyze them for fat content, impurities, any indications of disease, or other properties. The sample vials are then often discarded, so a large demand exists for inexpensive sample vials.

Certain sample vials commonly used for collecting milk specimens have previously been generally tubular with a round cross-section from bottom to top, a flat or concave bottom allowing the vials to stand up on a flat, level surface, and an integral lid joined to the body by an integral hinge. The sample vials have been carried in racks, resembling a common test tube rack, having wells that each receive a vial but do not latch the vial in place.

One piece liquid-tight vials are discussed in U.S. Pat. Nos. 4,783,056; 4,812,116; RE 37,676; and 6,303,064.

SUMMARY

One aspect of the present disclosure is a sample vial. The vial has a generally tubular body. The vial has a generally round lip defining an opening at the top of the body. The vial has an asymmetric foot at the base of the body, the asymmetric foot having asymmetric first and second sides. Another aspect of the present disclosure is a rack for supporting a sample vial having an asymmetric foot and a projecting abutment. The rack supports the sample vial in a generally upright position in a single orientation. The rack has an asymmetric recess adapted to receive the asymmetric foot in a single orientation. The rack also has an orientation abutment adapted to interfere with a projecting abutment of a vial to prevent insertion of a vial into the asymmetric recess in an orientation other than the single orientation. The orientation abutment also allows insertion of a vial into the asymmetric recess in the single orientation.

Another aspect of the present disclosure is an assembly of a vial and a vial rack.

The vial of the assembly has a vial body and an asymmetric foot at the base of the vial body. The vial also has a downward-projecting vial abutment generally at the base of the body.

The rack of the assembly includes a rack body and an asymmetric recess in the rack body adapted to receive the asymmetric foot in a single orientation. The rack also has an orientation abutment adapted to interfere with a downward-projecting vial abutment to prevent insertion of the vial into the asymmetric recess in an orientation other than a single orientation. The orientation abutment allows insertion of a vial into the asymmetric recess in the single orientation. Optionally, the vial of any embodiment can have a liquid tight seal between the lid and the vial body. The liquid tight properties of the seal can be retained during multiple lid opening and closing. The generally round shape at the top of the vial body is well suited to obtain a liquid tight seal. Optionally, the asymmetric foot of any embodiment can have a bottom shaped to prevent the vial from standing upright when placed on a flat, level surface. Optionally, the bottom of the asymmetric foot can be convex.

Optionally, the vial of any embodiment can have a lid engageable with its lip to close the opening.

Optionally, the vial of any embodiment can have a tether connecting the lid to the body.

Optionally, the vial of any embodiment can have an integral hinge connecting the lid to the body.

Optionally, the asymmetric foot of any embodiment of the vial can be generally egg-shaped.

Optionally, the asymmetric foot of any embodiment of the vial can be configured to be received in a single orientation in a well of corresponding shape in a rack.

Optionally, the vial of any embodiment can have a lid engageable with its lip to close the opening.

Optionally, the vial of any embodiment can have a generally upward-facing abutment in the body.

Optionally, the vial of any embodiment can have a generally outward-projecting abutment generally at the base of the body.

Optionally, the vial of any embodiment can have a generally downward-projecting abutment generally at the base of the body.

Optionally, the tubular body of any embodiment can generally smoothly transition between a round lip and an asymmetric foot.

Optionally, the rack of any embodiment can have an inwardly-projecting latching abutment resiliently mounted adjacent to the recess and positioned to latch to an abutment of a vial inserted in the recess to secure the vial in the rack.

Optionally, the rack of any embodiment can have first and second inwardly-projecting latching abutments, each resiliently mounted adjacent to the recess and positioned to latch to an abutment of a vial inserted in the recess to secure the vial in the rack.

Optionally, the orientation abutment of any embodiment can be an upwardly-projecting abutment mounted adjacent to the recess.

Optionally, the orientation abutment of any embodiment can be an inwardly-projecting latching abutment resiliently mounted adjacent to the recess and positioned to latch to an abutment of a vial inserted in the recess to secure the vial in the rack.

Optionally, the rack of any embodiment can have multiple asymmetric recesses, each adapted to receive an asymmetric foot of a vial in a single orientation.

Optionally, the asymmetric foot of any embodiment can be positioned in the single orientation further into one of the asymmetric recesses than an asymmetric foot not positioned in the single orientation.

BRIEF DESCRIPTION OF DRAWING FIGURES

Figure 1:
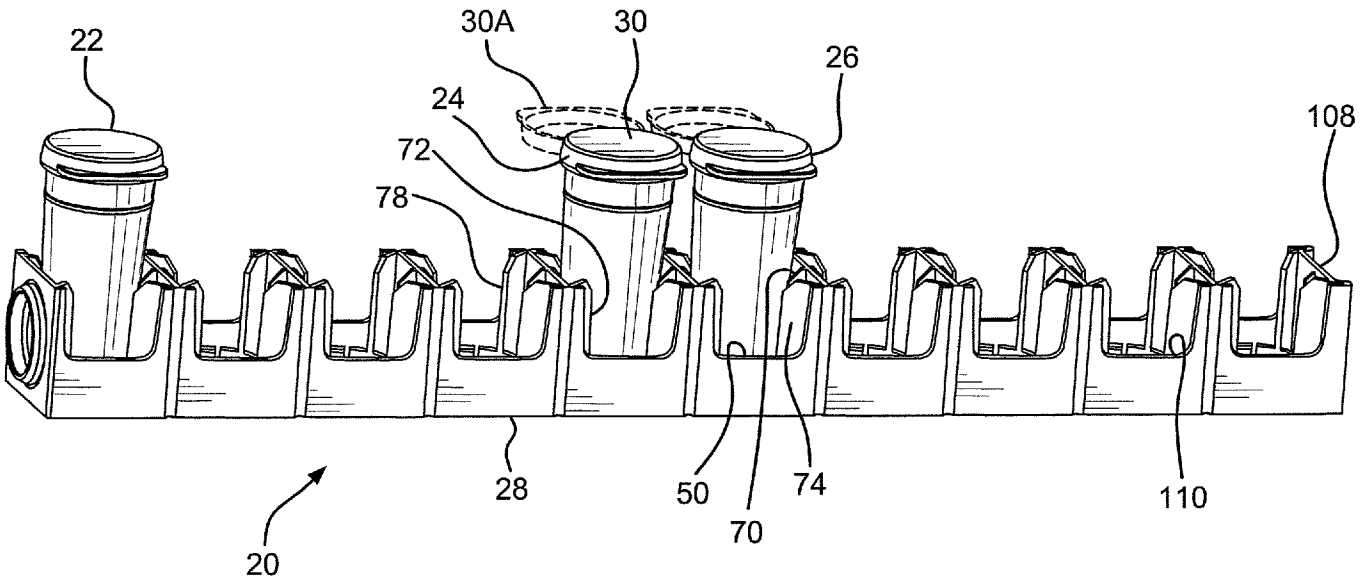
FIG. 1 is a perspective view of a rack containing several sample vials according to an aspect of the invention.

The following reference characters are used in the Figures.

| Ref. Char. | Description |
|---|---|
| 20 | Assembly of vials and rack |
| 22 | Vial |
| 24 | Vial |
| 26 | Vial |
| 28 | Rack |
| 30 | Lid of 24 |
| 30A | Lid of 24 |
| 31 | Integral hinge |
| 32 | Body of 24 |
| 34 | Lip of 24 |
| 36 | Opening of 24 |
| 38 | Asymmetric foot |
| 40 | Large-radius (first) side of 38 |
| 42 | Small-radius (second) side of 38 |
| 44 | Bottom of 24 |
| 46 | Downward abutment (of 24) |
| 48 | Upward abutment (of 24) |
| 50 | Recess (of 28) |
| 52 | Front wall (of 50) |
| 54 | Back wall (of 50) |
| 56 | Side wall (of 50 |
| 58 | Side wall (of 50) |
| 60 | Floor (of 50) |
| 62 | Collar (of 60) |
| 64 | Shorter front latching tab (of 50) |
| 66 | Back latching tab (of 50) |
| 68 | Side guide (of 50) |
| 70 | Side guide (of 50) |
| 72 | Front guide (of 50) |
| 74 | Front guide (of 50) |
| 76 | Back guide (of 50) |
| 78 | Back guide (of 50) |
| 80 | Upward-projecting abutment (of 50) |
| 82 | Orientation abutment (of 50) |
| 84 | Orientation abutment (of 50) |
| 86 | Vial (incorrectly positioned) |
| 88 | Edge (of 62) |
| 90 | Edge (of 62) |
| 92 | Bearing point (of 24) |
| 94 | Bearing point (of 24) |
| 96 | Bearing point (of 24) |
| 98 | Bearing point (of 24) |
| 100 | Inner margin (of 66) |
| 106 | Fixture (RFID ring) |
| 108 | Recess (end of rack) |
| 110 | Cut-out (of 52, 54) |
| 112 | Fill line |

DETAILED DESCRIPTION

The Figures show one embodiment of the invention.

FIG. 1 shows an assembly 20 of sample containers or vials 22, 24, and 26 in a rack 28. The sample vials such as 24 as illustrated have lids 30. The sample vials 24 and 26 are each shown with their lids such as 30 both in the closed position and the open position 30A (in dashed lines). The sample vials such as 24 have a tether 31, which in this case is more specifically an integral hinge 31, connecting the lid 30 to the body 32.

In FIG. 1, the vials 22, 24, and 26 are all properly seated in the same, correct orientation in the rack 28, with the lids such as 30 all opening from the front to the back and the hinges all at the back (and not visible in FIG. 1).

Figure 2:
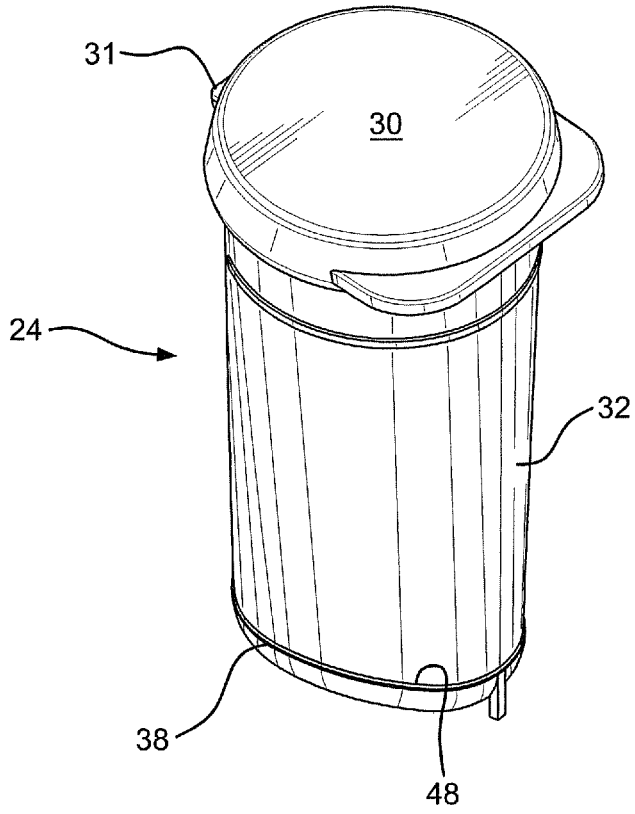
FIG. 2 is a perspective view of an isolated sample vial of the embodiment of FIG. 1.
Figure 3:
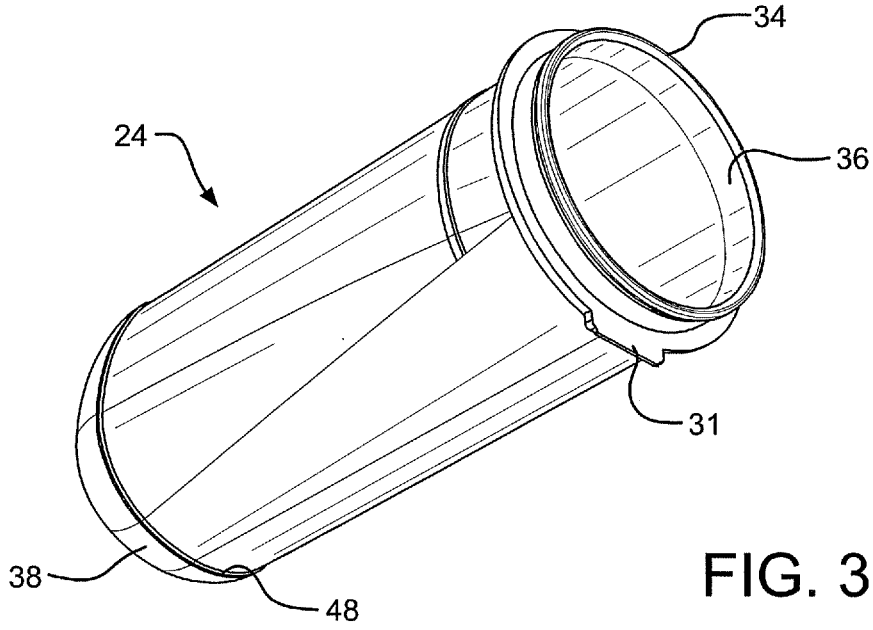
FIG. 3 is a perspective view of the sample vial of FIG. 2, with the lid cut away to show interior detail.
Figure 4:
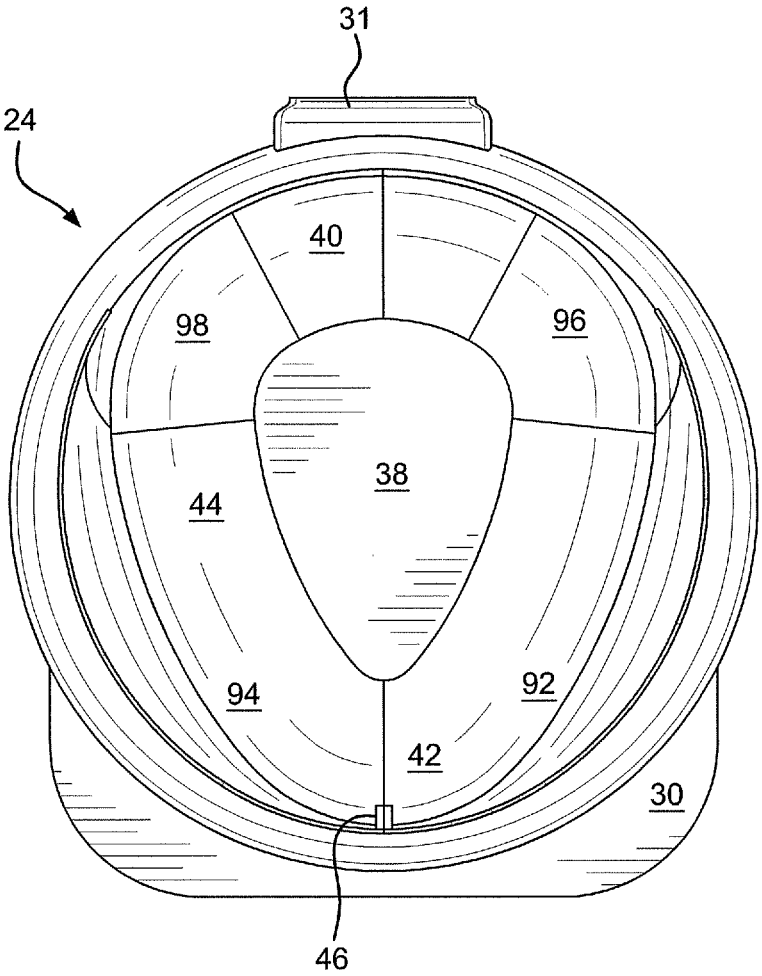
FIG. 4 is a bottom plan view of the sample vial of FIG. 2.
Figure 5:
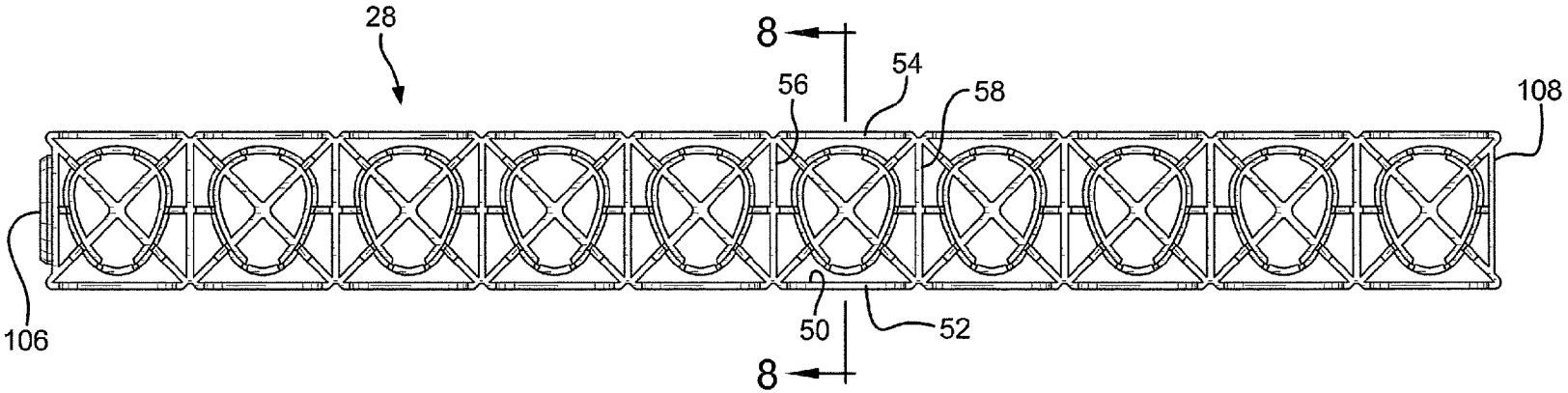
FIG. 5 is a top plan view of the embodiment of FIG. 1, with the sample vials removed.
Figure 6:
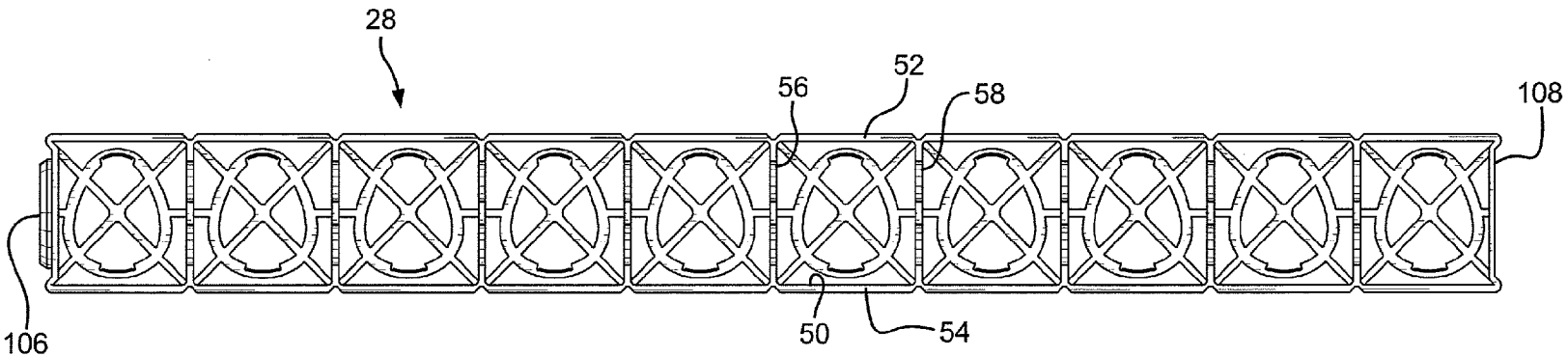
FIG. 6 is a bottom plan view of the embodiment of FIG. 1.

Referring now to FIGS. 2-4, the sample vial 24 has a generally tubular body 32. The sample vial 24 has a generally round lip 34 defining an opening 36 at the top of the body 32. The lid 30 is engageable with the lip 34 to close the opening 36. The sample vial 24 has an asymmetric foot 38 at the base of the body 32, the asymmetric foot 38 having asymmetric first and second, respectively large-radius and small-radius, sides 40 and 42.

In one embodiment, a liquid-tight and resealable vial such as 24 and lid such as 30 assembly is provided. The term "resealable" means that the vial can be opened/reopened and closed/reclosed several times (e.g. more than 5 times) and still retain its liquid-tight properties. The term "liquid-tight" means that the vial such as 24 passes a blue crystal dye test. The blue crystal dye test is a visual test to detect leaks within a vial seal. A vial such as 24 "passes" the blue crystal dye test if the white paper, in which the vial such as 24 is placed on, does not visually change color (i.e. the white paper does not become contaminated with the blue crystal dye liquid from the vial such as 24).

The blue crystal dye test procedure consists of the following: (a) the blue crystal dye liquid is prepared by adding one teaspoon of blue crystal dye powder to one gallon of alcohol and thoroughly mixing the solution; (b) the blue crystal dye liquid is poured into the vial such as 24 (i.e. a sufficient amount of the dye liquid must be added so, when the vial such as 24 is placed upside down, the entire seal area must be covered); (c) the lid such as 30 is fully closed on to the vial body; (d) the vial such as 24 is placed upside down (i.e. inverted) on the white paper at room temperature; and (e) after 30 minutes, the white paper is inspected to determine if the white paper is contaminated with the blue crystal dye liquid.

The asymmetric foot 38 has a bottom 44 shaped to prevent the sample vial 24 from standing upright when placed on a flat, level surface. As illustrated, the bottom 44 of the asymmetric foot 38 is convex. Alternatively, other shapes, such as pyramidal, a flat surface with a projecting part, a slanted surface, or other configurations can be used, or the sample vial 24 could have a bottom allowing it to stand upright in an alternative embodiment.

Referring specifically to FIG. 4, the asymmetric foot 38 as illustrated does have a plane of symmetry—the left and right halves of the foot 38 are symmetrical about a vertical plane passing through the center. The foot 38 is referred to as asymmetric here, however, because the top and bottom sides of the foot 38 are asymmetrical about a horizontal plane passing through the center. The criterion determining that a foot is asymmetric for the present purpose is that a change in the orientation of the foot changes its position as received in the rack 28, as will be shown below.

Figure 11:
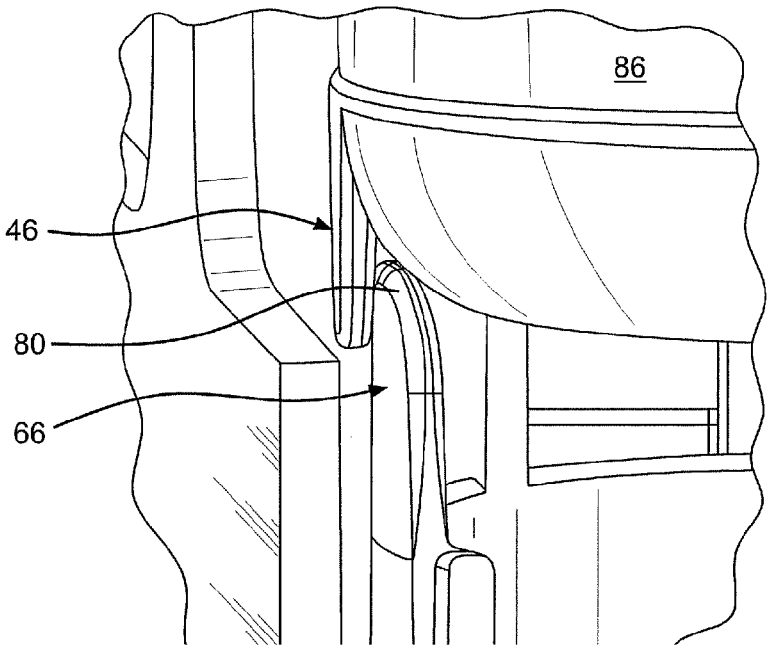
FIG. 11 is a greatly enlarged detail perspective view of the incorrectly oriented vial and rack of FIG. 10, with overlying structure of the rack cut away to show the interaction of the vial and the rack.

The sample vial 24 as illustrated has a generally outward-projecting and/or downward-projecting abutment 46, which can be a key or key tab, for example. In this embodiment, the abutment 46 is generally at the base of the body 32, and projects both outward and downward from the body 32. The downward and outward projection of the abutment 46 from the body 32 is best seen in FIG. 11. The sample vial 24 also has an upward facing abutment or snap ring 48 that interacts with the rack 28, as explained below.

In the Figures, the tubular body 32 has a generally smoothly transition between the round lip 34 and the asymmetric foot 38. A more abrupt transition can alternatively be provided.

Figure 7:
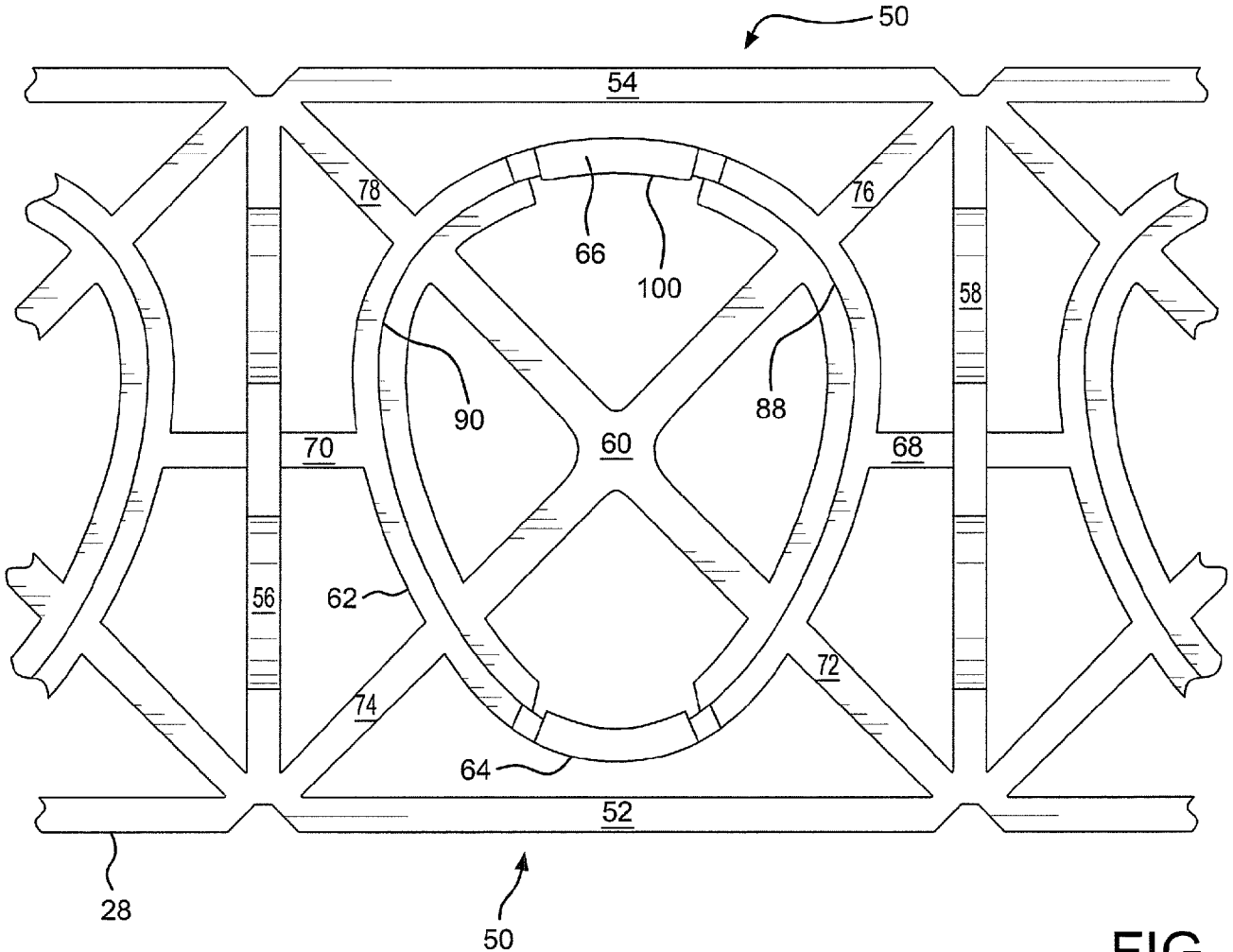
FIG. 7 is an enlarged detail view of a cell of the rack shown in FIG. 5.

Referring now to FIGS. 1 and 7 in particular, the rack 28 has one or more recesses or wells such as 50, and here ten asymmetric or nesting recesses such as 50, each adapted to receive an asymmetric foot 38 of a sample vial 24 in a single orientation. The single orientation is the orientation of each vial in FIG. 1.

The recess 50 is defined by a front wall 52, a back wall 54, side walls 56 and 58, a floor 60, a collar 62, a shorter front latching tab 64, and a longer back latching tab 66. The latching tabs may alternatively be known as snap tabs, snap ribs, snap springs, or snap rings. The recess 50 as illustrated has side guides 68 and 70, longer front guides 72 and 74, and shorter back guides 76 and 78. As will be apparent, the rack 28 and its recesses such as 50 are skeletonized to a large degree to save on weight and material and to allow fluids to drain readily from the rack 28.

Figure 8:
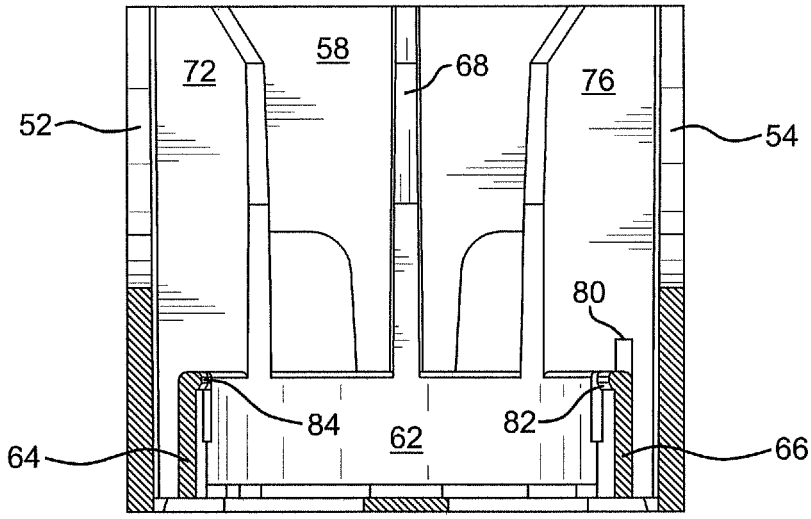
FIG. 8 is a section taken along section lines 8-8 of FIG. 5.
Figure 9:
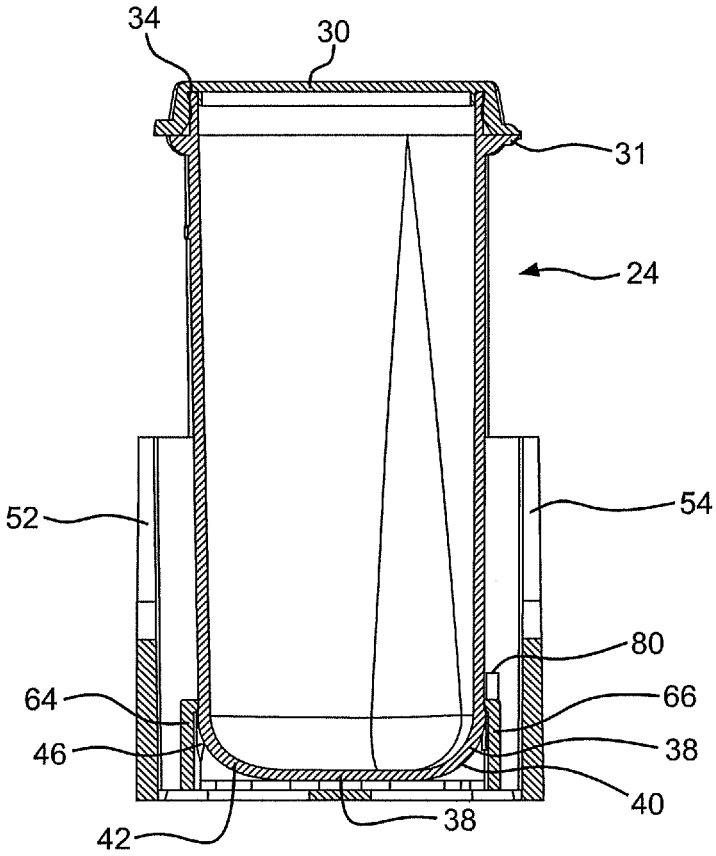
FIG. 9 is a view similar to FIG. 8, with the vial present.

Plural abutments can be differentiated, as by making one stand taller than another with respect to the recess, to assist with orientation of the sample vial 24 in the recess. For example, FIG. 9 shows that the front latching tab 64 of this embodiment can be shorter than the back latching tab 66. The extra height of the taller back latching tab 66 defines an upwardly-projecting abutment 80 mounted adjacent to the recess 50. The latching tabs 66 and 64, as most easily seen in FIGS. 8 and 9, each have an inwardly-projecting latching abutment, respectively 82 and 84, resiliently mounted adjacent to the recess 50 and positioned to latch to the abutment or shoulder 48 of a sample vial 24 inserted in the recess 48 to secure the sample vial 24 in the rack 28. Optionally, the rack 28 can have one, two, or more inwardly-projecting latching abutments such as 82 and 84, also known as orientation abutments.

The rack 28 supports the sample vial 24 in a generally upright position in a single orientation in the recess 50. The orientation feature of the rack 28 allows the asymmetric foot 38 to be positioned further into one of the asymmetric recesses, when oriented in the intended single orientation, than an asymmetric foot 38 not oriented in the single orientation.

Figure 10:
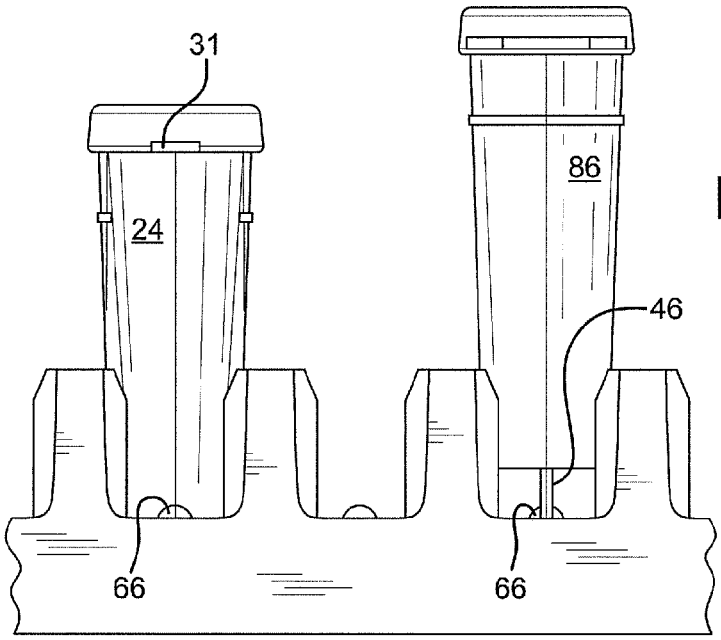
FIG. 10 is a detail side elevation of an alternative embodiment of the vial in a rack, in which one vial is incorrectly oriented and the other is correctly oriented.

There is only one way to successfully insert the asymmetric foot 38 into the recess 50, or at least fully into the recess 50. As a result, if in this embodiment a sample vial 24 is not oriented correctly, it will stand in the rack 28 at a different height than the vials that are correctly inserted, providing a visual cue that one of the vials is not inserted correctly. This is illustrated in FIG. 10, in which the sample vial 24 is inserted in the single correct orientation, with the back of the vial 24 (having the integral hinge 31) within and latched to the back latching tab 66 of the recess 50. In FIG. 10, the sample vial 86 is turned backward in the recess 50, and its front side (having the downward facing abutment 46) engages the latching tab 66. As illustrated, the incorrectly positioned sample vial 86 is raised above the correctly positioned sample vials such as 24. This mis-orientation can be detected visually or by a simple machine detection system (such as an aperture having an upper edge higher than the top of a correctly oriented sample tube 24 but lower than the top of an incorrectly oriented sample tube 24, or an electric eye system having a beam of light that will be stopped by the raised vial 86 but not by the correctly oriented vial 24 that is not raised).

Several features of the vials such as 24 and the rack 28 optionally contribute to this orientation functionality, either independently or in combination with other features. One feature contributing to the ability to distinguish an incorrectly oriented sample vial such as 86, shown particularly in FIG. 11, is the upward-projecting abutment 80 on the rack 28 adapted to interfere with the projecting abutment 46 of a sample vial 24 to prevent insertion of a sample vial 24 into the asymmetric recess in an orientation other than the single orientation. The upward-projecting abutment 80 also allows insertion of a sample vial 24 into the asymmetric recess 50 in the single orientation, as when the sample vial 24 is in the correct orientation, the vial abutment 46 and the upward-projecting abutment 80 are on opposite sides of the rack, and do not engage each other.

Another feature contributing to the detection of improper sample vial orientation is the different heights of the front and back latching tabs 64 and 66. The taller back latching tab 66, with its upward-projecting abutment 80, stops the advance of the downward-facing abutment 46 at a higher elevation than it otherwise would.

Another feature contributing to the detection of an improper sample vial orientation is provided by the arrangement of the guides 72-78 relative to the dimensions of the vial such as 24. This is illustrated by comparing FIGS. 4 and 7 (noting that FIG. 4 shows the vial from the bottom, and FIG. 7 shows the rack from the top, so left and right are reversed from one to the other). The inner extremities of the guides 72-78 are defined by the edges 88 and 90. The guides 72-78 respectively bear against the sample vial 24 approximately at the bearing points 92, 94, 96, and 98 as shown in FIG. 4. The guides 72 and 74 extend radially inward further than the guides 76 and 78, while the bearing points 92 and 94 extend radially outward less than the bearing points 96 and 98. The "long" guides 72 and 74 bear on the "short" or low-radius bearing points 92 and 94, while the "short" guides 76 and 78 bear on the "long" or greater-radius bearing points 96 and 98. In other words, "long" confronts "short" in each case. In this orientation the asymmetric foot 38 is correctly positioned relative to the latching tabs 64 and 66, and the downward-facing abutment 46 passes by the upward projecting abutment 80 within the inner margin 100 of the back latching tab 66.

If the orientation of the sample vial 24 were reversed by rotating it 180 degrees about a vertical axis, "long" would confront "long" and "short" would confront "short." Specifically, the guide 74 and the bearing point 96 would abut, and the guide 72 and the bearing point 98 would abut, and so forth. This would displace the downward facing abutment 46 outward over, and thus into interference with, the upward-projecting abutment 80, as shown in FIG. 11.

The rack 28 of the assembly thus includes an asymmetric recess or base support structure in the rack body adapted to receive or support the asymmetric foot 38 in a single orientation. The rack 28 also has an upward-projecting abutment 80 adapted to interfere with the downward-projecting vial abutment 46 to prevent insertion of the sample vial 24 into the asymmetric recess 50 in an orientation other than a single orientation. The upward-projecting abutment 80 allows insertion of a sample vial 24 into the asymmetric recess in the single orientation.

Optionally, the rack 28 can have a fixture 106, such as an RFID ring, adapted for receiving a radio frequency identification (RFID) tag, so the rack 28 can be labeled. Optionally, the individual sample vials such as 22, 24, and 26 of the rack 28 can be identified by their positions in the rack 28. For example, the fixture 106 can be on one end of the rack 28, and the other end of the rack 28 can be provided with a recess 108 to receive the bracket or fixture of an adjacent, butted rack so the pitch between adjacent sample vials such as 24 and 26 in a rack 28, and the pitch between the last sample vial 24 of one rack 28 and the first sample vial 24 of another rack butted against the first one are all constant. A constant pitch may be useful to facilitate stepping a row of butted racks by a distance equal to the pitch to sequentially perform operations on the vials such as automated vial opening, sample removal, or vial closing, as may be performed on an automated analysis machine in certain embodiments.

Optionally, the rack 28 can have cut-outs such as 110 in the front and/or back walls 52 and 54 of each recess 50 to facilitate reading the labels of sample vials such as 24 carried in the rack 28. A fill line 112 can be provided.

Another aspect of the present disclosure is an assembly of a vial such as 24 and a vial rack 28, each as described.

Certain embodiments of the invention have been described in detail in this specification and illustrated by the drawing figures. This invention is not limited, however, to the specific embodiments and features described in the specification. The invention extends to the full scope of the claims as initially or later presented in this specification.

What is claimed is:

1. An assembly of a vial and a vial rack:

the vial comprising:

a vial body;

an asymmetric foot at the base of the vial body; and a vial abutment that extends away from the base of the vial body;

the rack comprising:

a rack body;

an asymmetric recess in the rack body adapted to receive the asymmetric foot in a single orientation; and an orientation abutment adapted to: (1) engage the vial abutment to prevent insertion of the vial into the asymmetric recess in an orientation other than the single orientation, and (2) not engage the vial abutment when the vial is inserted into the asymmetric recess in the single orientation.

2. The invention of claim 1, in which the asymmetric foot has a bottom shaped to prevent the vial from standing upright when placed on a flat, level surface.

3. The invention of claim 1, in which the asymmetric foot is generally egg-shaped.

4. The invention of claim 1, in which the asymmetric foot is received in a single orientation in a well of corresponding shape in the rack.

5. The invention of claim 1, further comprising a generally upward-facing abutment in the vial body.

6. The invention of claim 1, wherein the vial abutment is a generally outward-projecting abutment.

7. The invention of claim 1, wherein the vial abutment generally projects downward from the base of the vial body.

* * * * *